US008116644B2

(12) United States Patent
Ichikawa

(10) Patent No.: US 8,116,644 B2
(45) Date of Patent: Feb. 14, 2012

(54) IMAGE FORMING APPARATUS AND WASTE POWDER TRANSPORTING METHOD

(75) Inventor: Tomoya Ichikawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 373 days.

(21) Appl. No.: 12/389,586

(22) Filed: Feb. 20, 2009

(65) Prior Publication Data

US 2010/0080578 A1 Apr. 1, 2010

(30) Foreign Application Priority Data

Sep. 26, 2008 (JP) ..... 2008-249039

(51) Int. Cl.
*G03G 21/12* (2006.01)
*G03G 21/00* (2006.01)

(52) U.S. Cl. ..... 399/35; 399/34; 399/360

(58) Field of Classification Search ..... 399/12, 399/34, 35, 44, 358, 360
See application file for complete search history.

(56) References Cited

U.S. PATENT DOCUMENTS 3,838,922 A * 10/1974 Nelson ..... 399/35
4,627,716 A * 12/1986 Oka ..... 399/360
5,130,756 A * 7/1992 Taniyama ..... 399/358
5,400,127 A * 3/1995 Arai et al. ..... 399/358 X
5,933,690 A * 8/1999 Sugimoto et al. ..... 399/358 X
6,014,541 A * 1/2000 Kato et al. ..... 399/358
6,266,511 B1 7/2001 Murakami et al. ..... 399/358
7,068,968 B2 * 6/2006 Choi et al. ..... 399/360
7,120,366 B2 10/2006 Onodera et al.
7,315,723 B2 * 1/2008 Suda et al. ..... 399/358

FOREIGN PATENT DOCUMENTS

JP 05-289584 11/1993
JP 2000-284660 10/2000
JP 2001-117458 4/2001
JP 2004-045981 2/2004
JP 2005-195864 7/2005
JP 2005-242274 9/2005
JP 2007-101572 4/2007
JP 2008-070804 3/2008

* cited by examiner

*Primary Examiner* — Sandra Brase
(74) *Attorney, Agent, or Firm* — Morgan, Lewis & Bockius LLP

(57) ABSTRACT

An image forming apparatus includes: an image forming section that forms an image on a recording medium; a storage container that is detachably and attachably provided and that stores waste powder having been discarded and transported from the image forming section; a first transporting section that transports, from the image forming section, the waste powder having been discarded in the image forming section; a transport path through which the waste powder having been transported by the first transporting section is caused to fall down and is transported; a second transporting section that transports, to the storage container, the waste powder having been transported through the transport path; and a controller that stops driving of the second transporting section if an operation set in advance is executed when the storage container is removed.

15 Claims, 8 Drawing Sheets

IMAGE FORMING APPARATUS AND WASTE POWDER TRANSPORTING METHOD

CROSS REFERENCE TO RELATED APPLICATIONS

This application is based on and claims priority under 35 USC §119 from Japanese Patent Application No. 2008-249039 filed Sep. 26, 2008.

BACKGROUND

1. Technical Field

The present invention relates to an image forming apparatus and a waste powder transporting method.

2. Related Art

Some image forming apparatuses are provided with a recovery device that recovers, as a waste toner, a toner that has not been used for image formation.

SUMMARY

According to an aspect of the present invention, there is provided an image forming apparatus including: an image forming section that forms an image on a recording medium; a storage container that is detachably and attachably provided and that stores waste powder having been discarded and transported from the image forming section; a first transporting section that transports, from the image forming section, the waste powder having been discarded in the image forming section; a transport path through which the waste powder having been transported by the first transporting section is caused to fall down and is transported; a second transporting section that transports, to the storage container, the waste powder having been transported through the transport path; and a controller that stops driving of the second transporting section if an operation set in advance is executed when the storage container is removed.

BRIEF DESCRIPTION OF THE DRAWINGS

Exemplary embodiment(s) of the present invention will be described in detail based on the following figures, wherein:

FIG. 7 is a diagram showing a return sequence of the transporting mechanism and the like.

DETAILED DESCRIPTION

An exemplary embodiment of the present invention will be described in detail below with reference to the accompanying drawings.

Figure 1:
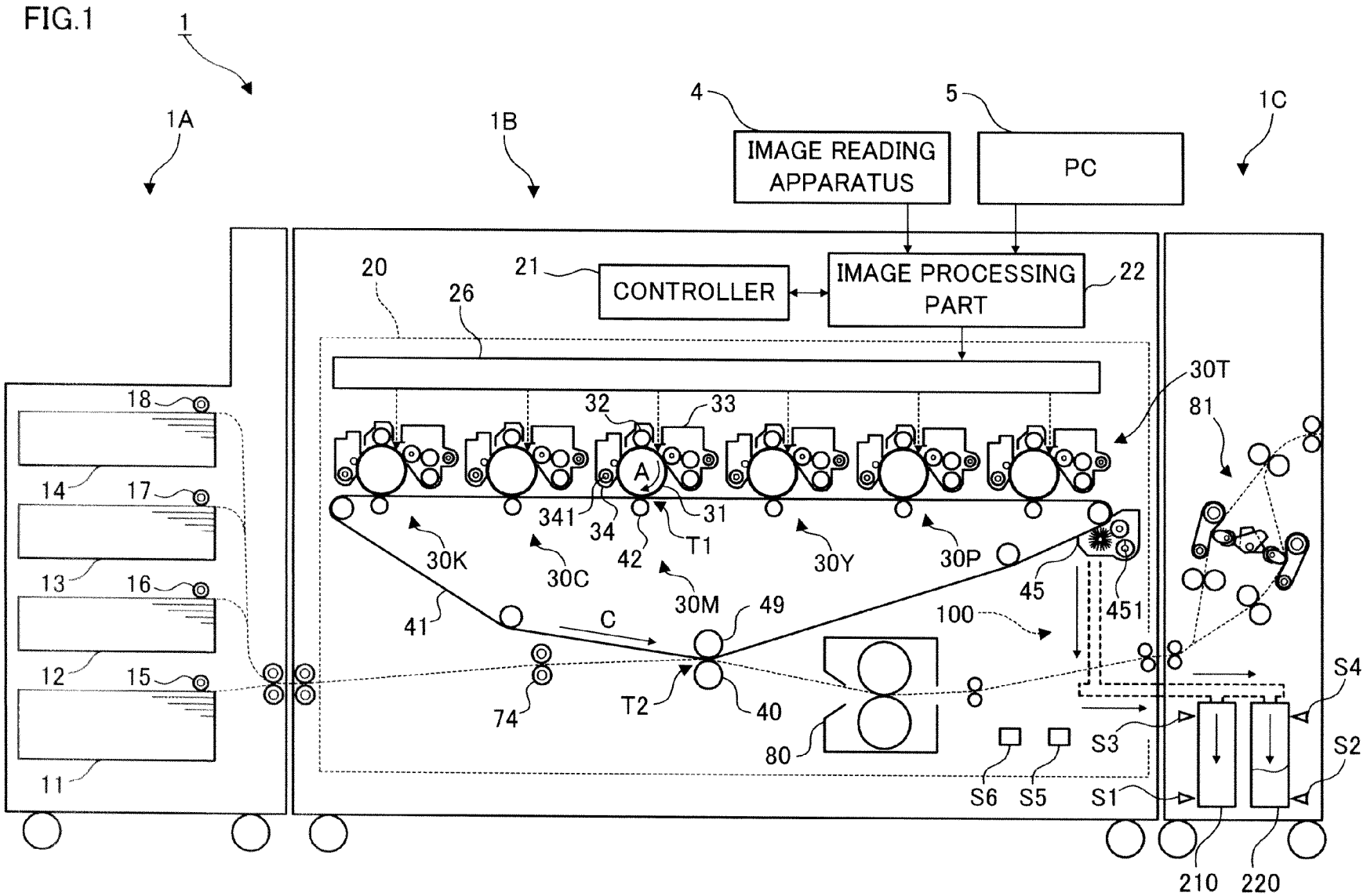
FIG. 1 is a diagram showing a configuration of a digital color printer as an example of an image forming apparatus.

FIG. 1 is a diagram showing a configuration of a digital color printer as an example of an image forming apparatus to which the exemplary embodiment is applied.

The image forming apparatus 1 of the present exemplary embodiment includes a sheet feeding unit 1A, an image formation unit 1B, and a sheet outputting unit 1C.

The sheet feeding unit 1A includes a first sheet storage part 11 to a fourth sheet storage part 14, each of which stores paper sheets serving as an example of a recording medium. The sheet feeding unit 1A further includes sending rolls 15 to 18 provided respectively for the first to fourth sheet storage parts 11 to 14. The sending rolls 15 to 18 send paper sheets stored in the respective sheet storage parts 11 to 14 to transport paths each connected to the image formation unit 1B.

The image formation unit 1B is of a so-called tandem type, and includes an image forming process part 20, a controller 21, and an image processing part 22. The image forming process part 20 forms an image on a paper sheet on the basis of image data of each color. The controller 21 controls the image forming process part 20 and the like. The image processing part 22 is connected, for example, to an image reading apparatus 4 and a personal computer (PC) 5, and performs image processing on image data received from these devices.

The image forming process part 20, as an example of an image forming section, includes six image forming units 30T, 30P, 30Y, 30M, 30C, and 30K (hereinafter, sometimes referred to simply as "image forming units 30") arranged in parallel at intervals. Each image forming unit 30 includes a photoconductor drum 31, a charging roll 32, a developing device 33, and a cleaning unit 34. An electrostatic latent image is formed on the photoconductor drum 31 while the photoconductor drum 31 is rotating in a direction indicated by an arrow A in the figure. The charging roll 32 electrically charges a surface of the photoconductor drum 31 uniformly. The developing device 33 develops the electrostatic latent image formed on the photoconductor drum 31. The cleaning unit 34 removes an untransferred toner and the like on the surface of the photoconductor drum 31. In addition, the image forming process part 20 is provided with a laser exposure device 26 that scans and exposes, with a laser beam, the photoconductor drums 31 of the respective image forming units 30T, 30P, 30Y, 30M, 30C, and 30K. Moreover, the image forming process part 20 includes a motor (not shown in the figure) to rotationally drive the respective photoconductor drums 31 of the image forming units 30T, 30P, 30Y, 30M, 30C, and 30K. Note that, in the specification, the motor to rotationally drive the respective photoconductor drums 31 is referred to as a sixth motor M6 for the convenience of description.

Here, all the image forming units 30 have almost the same configuration except for the toner stored in the respective developing devices 33. Yellow (Y), magenta (M), cyan (C), and black (K) toner images are formed in the image forming units 30Y, 30M, 30C, and 30K, respectively.

Meanwhile, in addition to the commonly-used four colors (normal colors), that is, yellow, magenta, cyan, and black, another image forming material is sometimes desired to be used in the forming of an image on a paper sheet. Specifically, there is a case where an image is desired to be formed on a paper sheet by using an image forming material, such as a spot color, that is difficult or impossible to be expressed with the commonly-used four colors. For example, an image is sometimes desired to be formed on a paper sheet by using a toner, such as a toner of a corporate color dedicated to a specific user, a foam toner for Braille, a fluorescent toner, a toner that improves a gloss, a ferromagnetic toner, an invisible toner having sensitivity to the infrared region, or the like. For this reason, the image formation unit 1B of the present exemplary embodiment is provided with image forming units 30T and 30P that achieve image formation using a spot color and the like, in addition to the generally-mounted image forming units 30Y, 30M, 30C, and 30K.

Moreover, the image forming process part 20 includes the intermediate transfer belt 41, primary transfer rolls 42, a secondary transfer roll 40, a belt cleaner 45, and a fixing device 80. Onto the intermediate transfer belt 41, various color toner images formed by the photoconductor drums 31 of the respective image forming units 30 are superimposedly transferred. The primary transfer rolls 42 sequentially transfer (primarily transfer) the various color toner images of the respective image forming units 30 onto the intermediate transfer belt 41 at a primary transfer portion T1. The secondary transfer roll 40 transfers (secondarily transfers) the superimposed toner images, which have been transferred onto the intermediate transfer belt 41, together onto a paper sheet at a secondary transfer portion T2. The belt cleaner 45 removes an untransferred toner and the like on the surface of the intermediate transfer belt 41. The fixing device 80 fixes a secondarily transferred image onto the paper sheet.

The image forming process part 20 performs an image forming operation on the basis of control signals sent from the controller 21. First, image data inputted through the image reading apparatus 4 or the PC 5 are subjected to image processing by the image processing part 22, and then supplied to the laser exposure device 26. Then, for example, in the magenta (M) image forming unit 30M, after the surface of the photoconductor drum 31 is uniformly charged with a potential set in advance, by the charging roll 32, the photoconductor drum 31 is scanned and exposed by the laser exposure device 26 with a laser beam modulated according to the image data acquired from the image processing part 22. In this way, an electrostatic latent image is formed on the photoconductor drum 31. The electrostatic latent image thus formed is developed by the developing device 33, so that a magenta toner image is formed on the photoconductor drum 31. In the same manner, yellow, cyan, and black toner images are formed respectively in the image forming units 30Y, 30C, and 30K, and also, toner images of spot colors or the like are formed respectively in the image forming units 30T and 30P.

These color toner images having been formed in the respective image forming units 30 are electrostatically transferred (primarily transferred) in sequence by the corresponding primary transfer rolls 42 onto the intermediate transfer belt 41 rotating in a direction indicated by an arrow C in FIG. 1, so that superimposed toner images are formed on the intermediate transfer belt 41.

On the other hand, the untransferred toner and the like remaining on each photoconductor drum 31 at the primary transfer are removed (discarded) by the cleaning unit 34 disposed downstream of the primary transfer roll 42. Each cleaning unit 34 includes a transporting member 341 provided along an axial direction of the photoconductor drum 31. The transporting member 341 transports the removed untransferred toner and the like to a rear side (back part side) of the image formation unit 1B. The untransferred toner and the like (a waste powder) transported by the transporting member 341 to the rear side of the image formation unit 1B are then transported by a transporting mechanism 100 to a first storing container 210 or a second storing container 220. Here, the transporting mechanism 100 is provided also in the rear side of the image formation unit 1B, while the first and second storing containers 210 and 220 are both detachably and attachably provided in the sheet outputting unit 1C.

Here, in the present exemplary embodiment, two storing containers are provided. Specifically, the two storing containers are the first storing container 210 and the second storing container 220. Accordingly, for example, even if any one of the storing containers is filled up, this configuration allows an image forming operation to be continuously performed by transporting the untransferred toner and the like to the other one of the storing containers. Moreover, for example, this configuration also allows a reduction in weight of the storing container that contains the untransferred toner and the like therein when the storing container is detached, as compared with a configuration in which the untransferred toner and the like are stored in a single storing container having a large capacity.

In addition, in the present exemplary embodiment, a first sensor S1 and a second sensor S2 are provided. The first sensor S1 performs detection on the first storing container 210, while the second sensor S2 performs detection on the second storing container 220. A third sensor S3, which outputs a signal set in advance when the untransferred toner and the like reach an upper portion of the first storing container 210 (when the first storing container 210 is filled up with the untransferred toner and the like), is also provided. Further, a fourth sensor S4, which outputs a signal set in advance when the untransferred toner and the like reach an upper portion of the second storing container 220 (when the second storing container 220 is filled up with the untransferred toner and the like), is provided. Furthermore, in the present exemplary embodiment, a temperature sensor S5 and a humidity sensor S6 are provided. The temperature sensor S5 measures the inside temperature of the image forming apparatus 1, while the humidity sensor S6 measures the inside humidity of the image forming apparatus 1. Note that, although the first storing container 210 and the second storing container 220 are provided in the sheet outputting unit 1C in the present exemplary embodiment, these storing containers may be provided alternatively in the image formation unit 1B.

On the other hand, the superimposed toner images formed on the intermediate transfer belt 41 are transferred, according to the movement of the intermediate transfer belt 41, toward the secondary transfer portion T2 in which the secondary transfer roll 40 and a backup roll 49 are disposed. Meanwhile, the paper sheet is transferred to a position of a registration roll 74 after being taken out of, for example, the first sheet storage part 11 by the sending roll 15 and then passing through the transport path.

At the timing when the superimposed toner images are transported to the secondary transfer portion T2, the paper sheet is fed to the secondary transfer portion T2 from the registration roll 74. Then, the superimposed toner images are electrostatically transferred (secondarily transferred) together onto the paper sheet by the action of a transfer electric field formed between the secondary transfer roll 40 and the backup roll 49 at the secondary transfer portion T2.

Thereafter, the paper sheet having the superimposed toner images electrostatically transferred thereon is peeled from the intermediate transfer belt 41, and then, is transported to the fixing device 80. The unfixed toner images on the paper sheet having been transported to the fixing device 80 are subjected to a fixing process with heat and pressure by the fixing device 80 so as to be fixed onto the paper sheet. Then, the paper sheet having a fixed image formed thereon passes through a curl correcting part 81 provided in the sheet outputting unit 1C, and then, is transported to an outputted-sheet stacking unit (not shown in the figure).

On the other hand, the untransferred toner and the like remaining on the surface of the intermediate transfer belt 41 after the secondary transfer are removed (discarded) by the belt cleaner 45, which is disposed in contact with the intermediate transfer belt 41, after the completion of the secondary transfer. The belt cleaner 45 includes a transporting member 451 that is provided to extend from the front side to the rear side of the image formation unit 1B, and that transports the untransferred toner and the like thus removed to the rear side of the image formation unit 1B. Then, the untransferred toner and the like (waste powder) transported to the rear side of the image formation unit 1B by the transporting member 451 are transported to the first storing container 210 or the second storing container 220 by the transporting mechanism 100. Note that, in the specification, the untransferred toner and the like transported from the cleaning unit 34 and the belt cleaner 45 to the transporting mechanism 100 are hereinafter referred to as a waste toner.

Subsequently, the transporting mechanism 100 will be described in detail.

Figure 2:
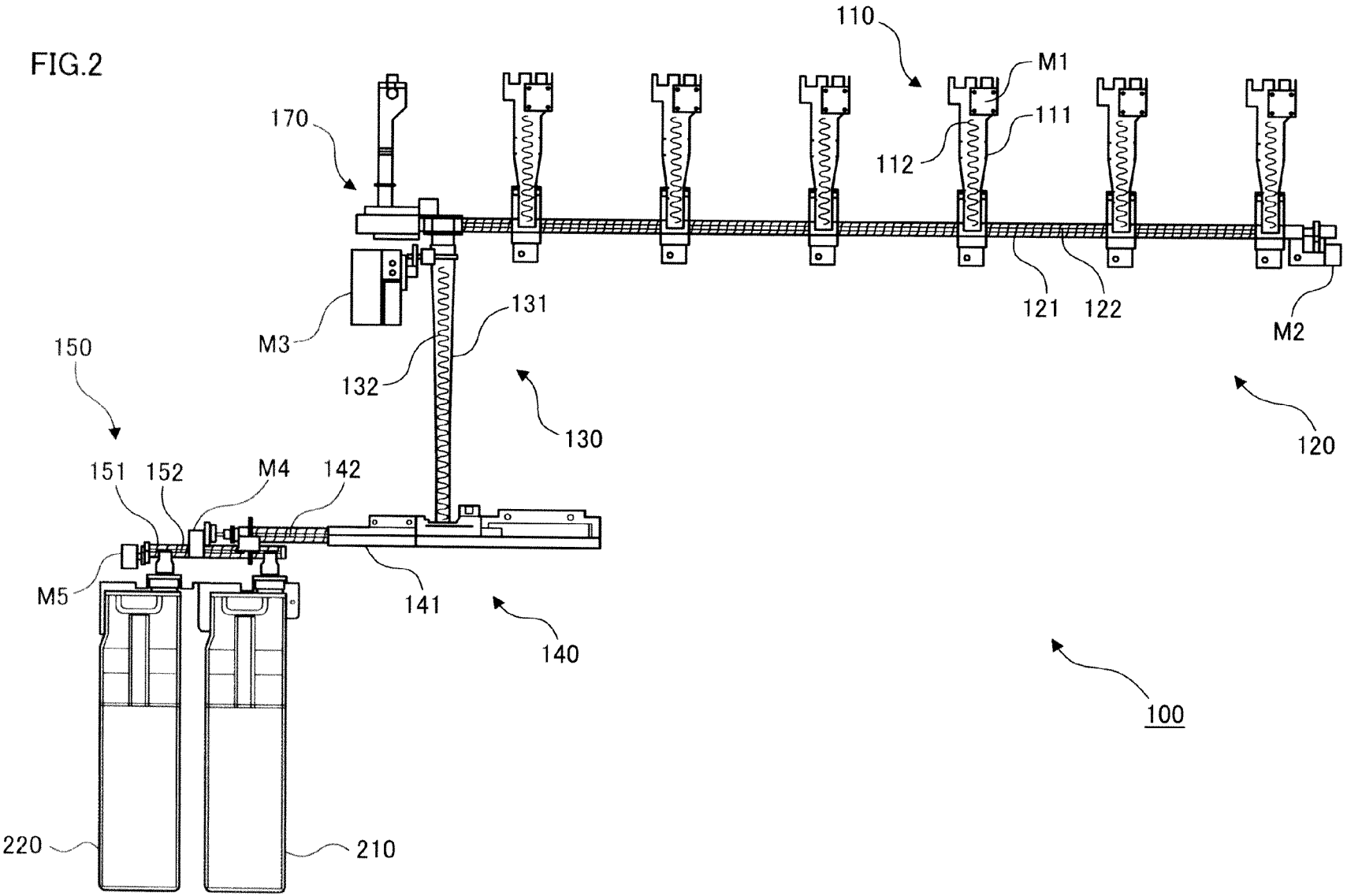
FIG. 2 is a diagram showing the transporting mechanism from the rear side of the image forming apparatus.

FIG. 2 is a diagram showing the transporting mechanism 100 from the rear side of the image forming apparatus 1.

As shown in FIG. 2, the transporting mechanism 100 includes first transporting mechanisms 110 that are provided corresponding to the respective image forming units 30, and that transport the waste toner from the cleaning units 34. In addition, the transporting mechanism 100 includes a discharging part 170 to which the waste toner from the belt cleaner 45 is discharged. Moreover, the transporting mechanism 100 includes a second transporting mechanism 120, a third transporting mechanism 130, a fourth transporting mechanism 140, and a fifth transporting mechanism 150. The second transporting mechanism 120 transports the waste toner having been transported by the first transporting mechanisms 110 and the waste toner having been discharged from the discharging part 170. The third transporting mechanism 130 transports the waste toner having been transported by the second transporting mechanism 120. The fourth transporting mechanism 140 transports the waste toner having been transported by the third transporting mechanism 130, and the fifth transporting mechanism 150 transports, to the first storing container 210 or the second storing container 220, the waste toner having been transported by the fourth transporting mechanism 140.

Note that the transporting member 341 (see FIG. 1), the first transporting mechanisms 110 and the second transporting mechanism 120 in the present exemplary embodiment may be taken as a first transporting section that transports the waste toner (waste powder) from the image forming process part 20 functioning as an image forming section. The fourth transporting mechanism 140 and the fifth transporting mechanism 150 in the present exemplary embodiment may be taken as a second transporting section that transports, to the first storing container 210 and the like, the waste toner transported via the transport path, which is formed by the tubular member 131 (which will be described later).

Each of the first transporting mechanisms 110 includes a tubular member 111, a coil spring 112, and a first motor M1. The tubular member 111 forms a transport path for the waste toner having been transported by the transporting member 341 (see FIG. 1) provided to the cleaning unit 34. The coil spring 112, which is an example of a breaking member, is provided inside the tubular member 111 and breaks down the waste toner adhering to an inner wall surface of the tubular member 111 by reciprocating along the tubular member 111. The first motor M1 rotationally drives the transporting member 341 and causes the coil spring 112 to reciprocate.

Each tubular member 111 is provided to extend in the up and down direction (the approximately vertical direction). Accordingly, the waste toner having been transported by the transporting member 341 falls down (free-falls) inside this tubular member 111.

Each coil spring 112 is formed of a wire, and has a helical (coil) shape. Specifically, each coil spring 112 does not have a rotational shaft unlike a transporting member 142 (see FIG. 4) having a rotational shaft 142A, which will be described later and has a shape allowing the waste toner to pass through the center portion thereof. In other words, the shape of each coil spring 112 allows the waste toner to fall down in the tubular member 111. Each coil spring 112 is caused to reciprocate inside the tubular member 111 by the first motor M1 so as to break down the waste toner having been agglomerated inside the tubular member 111 or to remove the waste toner from the inner wall of the tubular member 111.

The second transporting mechanism 120 includes a tubular member 121. The tubular member 121 is disposed to extend in an arrangement direction of the image forming units 30T, 30P, 30Y, 30M, 30C, and 30K (in the horizontal direction, approximately), is connected to the tubular members 111 and the discharging part 170, and forms a transport path for the waste toner. In addition, the second transporting mechanism 120 further includes the transporting member 122 and a second motor M2. The transporting member 122 is disposed inside the tubular member 121, and transports the waste toner having been transported from the first transporting mechanisms 110 and the waste toner having been discharged from the discharging part 170. The second motor M2 rotationally drives the transporting member 122. Incidentally, the transporting member 122 is configured similarly to the transporting member 142 and the transporting member 152 (see FIG. 4), both of which will be described later.

The transporting member 341 (see FIG. 1) in the present exemplary embodiment may be taken as an upstream-side transporting mechanism that transports the waste toner (waste powder) from the image forming process part 20 functioning as an image forming section. The transport path of the waste toner formed by the tubular member 111 may be taken as a falling-down transport path through which the waste powder falls down so as to be transported. Moreover, the second transporting mechanism 120 may be taken as a downstream-side transporting mechanism that transports the waste toner having been transported through the falling-down transport path to the transport path of the waste toner formed by the tubular member 131.

The third transporting mechanism 130 includes a tubular member 131 that is provided to extend in the up and down direction (the approximately vertical direction), that is connected to the tubular member 121, and that forms a transport path for the waste toner. In addition, the third transporting mechanism 130 includes a coil spring 132 and a third motor M3. The coil spring 132 is provided inside the tubular member 131, and is reciprocatable along the tubular member 131. The third motor M3 causes the coil spring 132 to reciprocate.

The tubular member 131 is provided to extend in the up and down direction (the approximately vertical direction). Accordingly, the waste toner having been transported by the second transporting mechanism 120 falls down (free-falls) inside this tubular member 131.

The coil spring 132 is formed of a wire, and also has a helical (coil) shape, as in the case of the coil spring 112. In addition, the coil spring 132 does not have a rotational shaft, and has a shape allowing the waste toner to pass through the center portion thereof, as in the above-described case. In other words, the shape of the coil spring 132 allows the waste toner to fall down in the tubular member 131. The coil spring 132 is caused to reciprocate inside the tubular member 131 by the third motor M3 so as to break down the waste toner having been agglomerated inside the tubular member 131 or to remove the waste toner from the inner wall of the tubular member 131.

Figure 3:
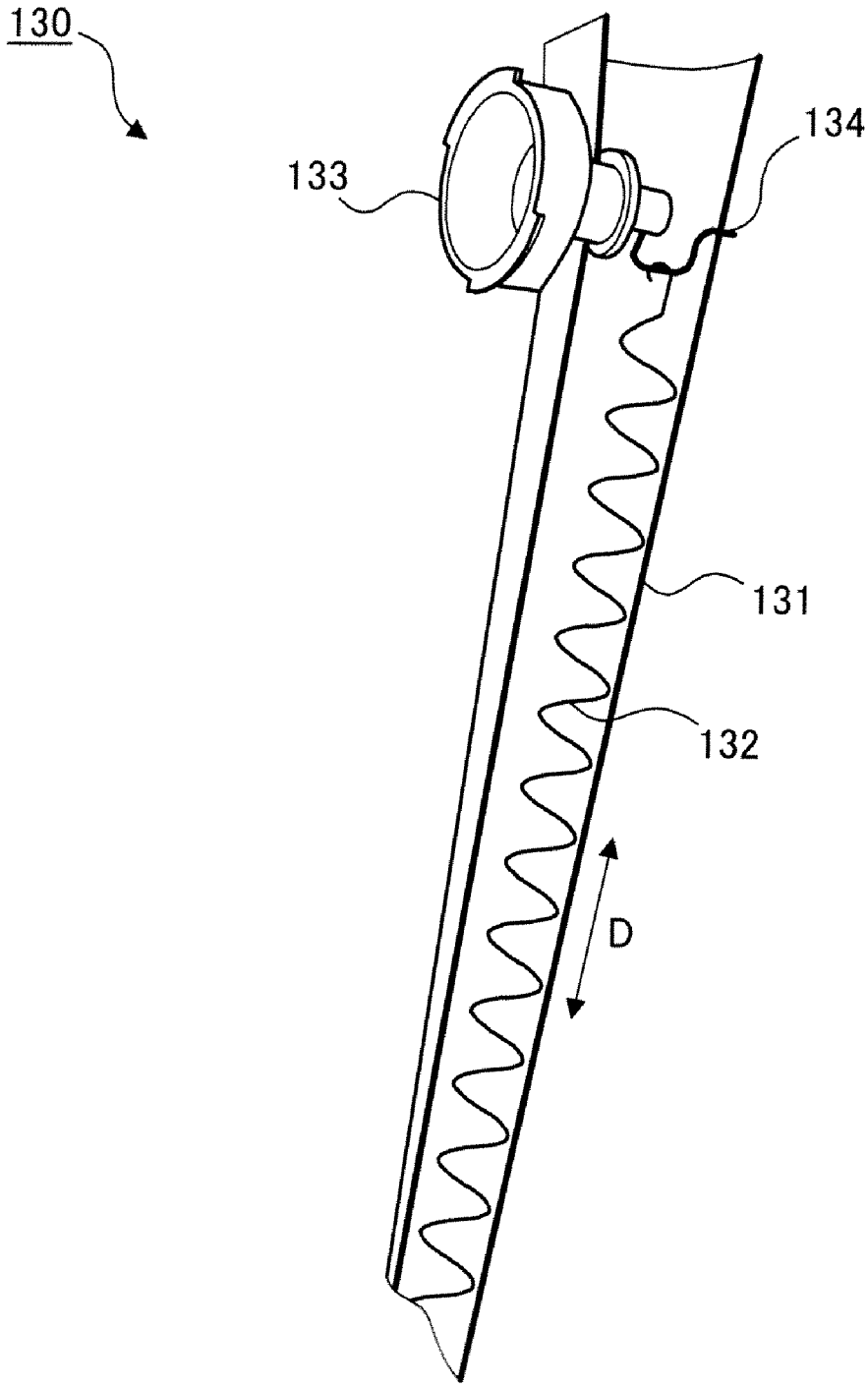
FIG. 3 is a diagram showing a reciprocation mechanism that causes the coil spring to reciprocate.

Note that, the reciprocation of the coil spring 132 is achieved by, for example, a configuration shown in FIG. 3.

Here, FIG. 3 is a diagram showing a reciprocation mechanism that causes the coil spring 132 to reciprocate. As shown in FIG. 3, the third transporting mechanism 130 includes a rotating member 133 and a driving member 134. The rotating member 133 is rotated by the third motor M3 (see FIG. 2). One end portion of the driving member 134 is attached to the rotating member 133, while an upper end portion of the coil spring 132 is attached to the driving member 134. The driving member 134 is formed in a crank shape. In addition, the driving member 134 is configured so that an attachment portion thereof to which the coil spring 132 is attached passes a position eccentric to the center of the axis of the rotating member 133 when the third motor M3 is driven. Accordingly, once the third motor M3 is started to be driven, the coil spring 132 is caused to reciprocate along the tubular member 131 (see an arrow D) by the driving member 134. Note that, although a description has been omitted above, each of the coil springs 112 in the first transporting mechanisms 110 (see FIG. 2) is also caused to reciprocate by the same mechanism as that shown in FIG. 3.

Referring back to FIG. 2 again, the transporting mechanism 100 will be further described.

The fourth transporting mechanism 140 includes a tubular member 141 that forms a transport path for the waste toner. The tubular member 141 is disposed to intersect (to be orthogonal to) the tubular member 131 in the third transporting mechanism 130. In other words, the tubular member 141 is arranged to extend in the approximately horizontal direction. Moreover, the fourth transporting mechanism 140 includes a transporting member 142 that is disposed inside the tubular member 141, and that transports the waste toner from the third transporting mechanism 130. Further, the fourth transporting mechanism 140 includes a fourth motor M4 that rotationally drives the transporting member 142.

The fifth transporting mechanism 150 includes a tubular member 151 that forms a transport path for the waste toner. The tubular member 151 is disposed below the tubular member 141 in the fourth transporting mechanism 140, and also is arranged parallel to the tubular member 141. The fifth transporting mechanism 150 further includes a transporting member 152 and a fifth motor M5. The transporting member 152 is disposed inside the tubular member 151, and transports the waste toner from the fourth transporting mechanism 140. The fifth motor M5 rotationally drives the transporting member 152.

Figure 4:
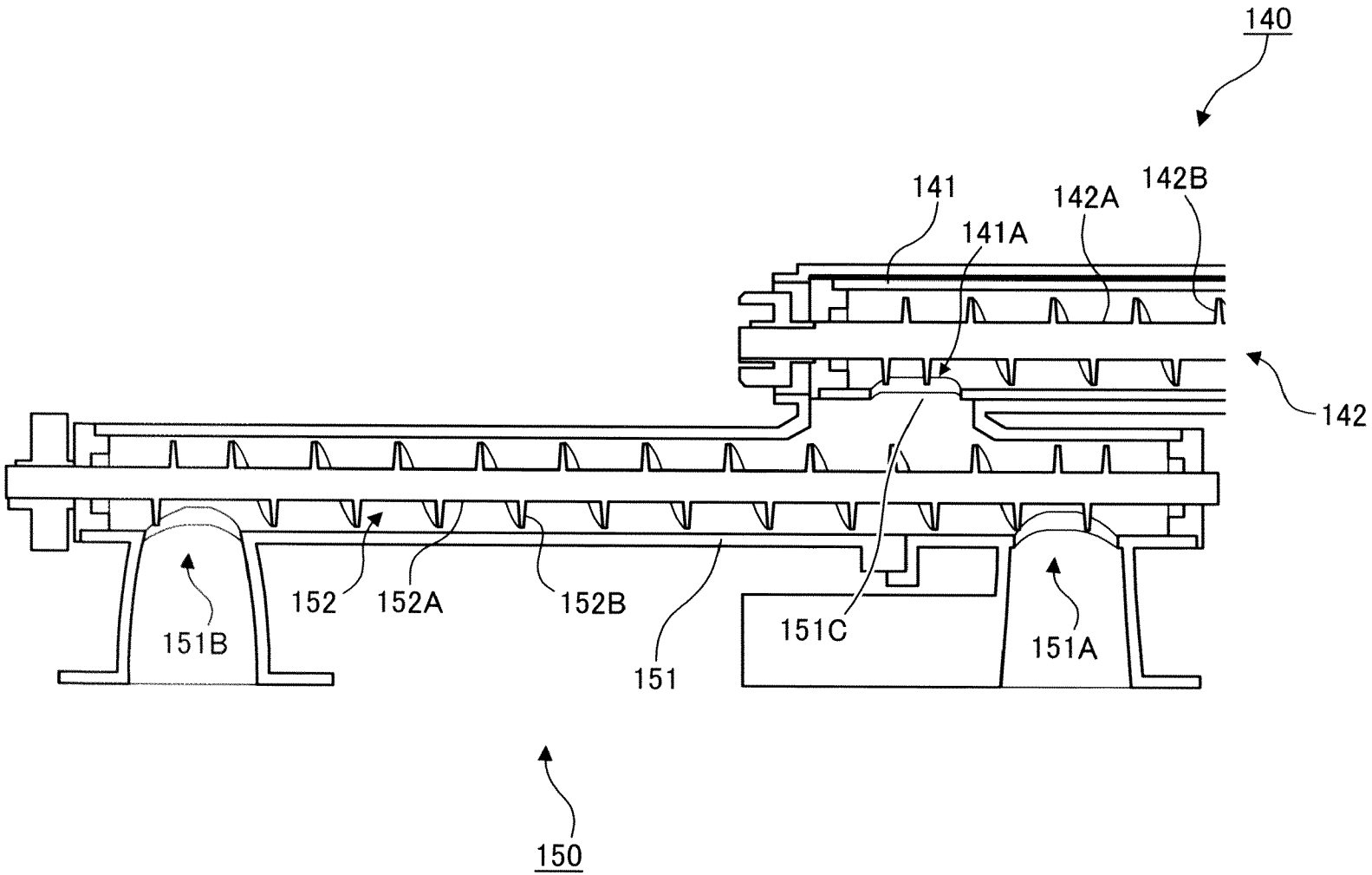
FIG. 4 is an enlarged diagram showing the fourth transporting mechanism and the fifth transporting mechanism.

Here, FIG. 4 is an enlarged view showing the fourth transporting mechanism 140 and the fifth transporting mechanism 150. With reference to FIG. 4, the fourth transporting mechanism 140 and the fifth transporting mechanism 150 will be further described.

The transporting member 142 in the fourth transporting mechanism 140 includes: a rotational shaft 142A that is rotated by the fourth motor M4 (see FIG. 2); and ridge portions 142B each provided to project from an outer peripheral surface of the rotational shaft 142A. The ridge portions 142B are provided in the form of fins around the rotational shaft 142A, and also provided in a helical (screw) shape along the axis of the rotational shaft 142A.

In addition, the tubular member 141 in the fourth transporting mechanism 140 includes a discharge outlet 141A at a lower portion in an end portion on the fifth transporting mechanism 150 side. Through the discharge outlet 141A, the waste toner having been transported by the transporting member 142 is discharged to the tubular member 151 in the fifth transporting mechanism 150.

On the other hand, as is the case with the transporting member 142, the transporting member 152 in the fifth transporting mechanism 150 also includes: a rotational shaft 152A that is rotated by the fifth motor M5 (see FIG. 2); and ridge portions 152B each provided to project from the rotational shaft 152A. The ridge portions 152B are provided in the form of fins around the rotational shaft 152A, and also provided in a helical (screw) shape along the axis of the rotational shaft 152A. Here, the transporting member 152 is provided along the transport path for waste toners formed by the tubular member 151. Moreover, the transporting member 152 is also provided to extend from the first discharge outlet 151A to the second discharge outlet 151B, both of which will be described later.

In addition, the tubular member 151 in the fifth transporting mechanism 150 includes a receiving port 151C that receives the waste toner from the discharge outlet 141A in the fourth transporting mechanism 140. Moreover, the tubular member 151 includes the first discharge outlet 151A. Through the first discharge outlet 151A, the waste toner having been received by the receiving port 151C and transported by the transporting member 152 is discharged to the first storing container 210 (see FIG. 2). Furthermore, the tubular member 151 includes the second discharge outlet 151B. Through the second discharge outlet 151B, the waste toner having been received by the receiving port 151C and transported by the transporting member 152 is discharged to the second storing container 220 (see FIG. 2).

Here, in the present exemplary embodiment, the first discharge outlet 151A is provided at a lower portion in one end portion of the tubular member 151, while the second discharge outlet 151B is provided at a lower portion in the other end portion of the tubular member 151. Meanwhile, the receiving port 151C is provided at an upper portion of the tubular member 151 between the first discharge outlet 151A and the second discharge outlet 151B.

Here, for example, when the fifth motor M5 (see FIG. 2) in the fifth transporting mechanism 150 is rotating in the forward direction, the forward rotation of the fifth motor M5 causes the transporting member 152 to be rotationally driven so as to transport the waste toner from the discharge outlet 141A to the second discharge outlet 151B. The waste toner thus transported to the second discharge outlet 151B falls down through the second discharge outlet 151B into the second storing container 220 located below the second discharge outlet 151B. Then, for example, if the second storing container 220 is filled up with the waste toner or removed, the controller 21 causes the fifth motor M5 to rotate in the reverse direction. The reverse rotation of the fifth motor M5 causes the transporting member 152 to be rotationally driven in the reverse direction so as to transport the waste toner from the discharge outlet 141A to the first discharge outlet 151A. The waste toner thus transported to the first discharge outlet 151A falls down through the first discharge outlet 151A into the first storing container 210 located below the first discharge outlet 151A.

In the present exemplary embodiment, the amount of the waste toner to be transported per unit time in the fourth transporting mechanism 140 is set to be not less than the amount of the waste toner to be transported per unit time in the second transporting mechanism 120. Accordingly, during a normal operation, the waste toner is basically not accumulated inside the tubular member 131. In other words, during the normal operation, the tubular member 131 has enough space for the accumulation of the waste toner. In addition, in the present exemplary embodiment, the amount of the waste toner to be transported per unit time in the second transporting mechanism 120 is set to be larger than the amount of the waste toner to be transported per unit time by the transporting members 341 (see FIG. 1) provided in the respective cleaning units 34. Accordingly, as in the case of the tubular member 131, during the normal operation, the tubular member 111 of each of the first transporting mechanisms 110 has enough space for the accumulation of the waste toner.

Figure 5:
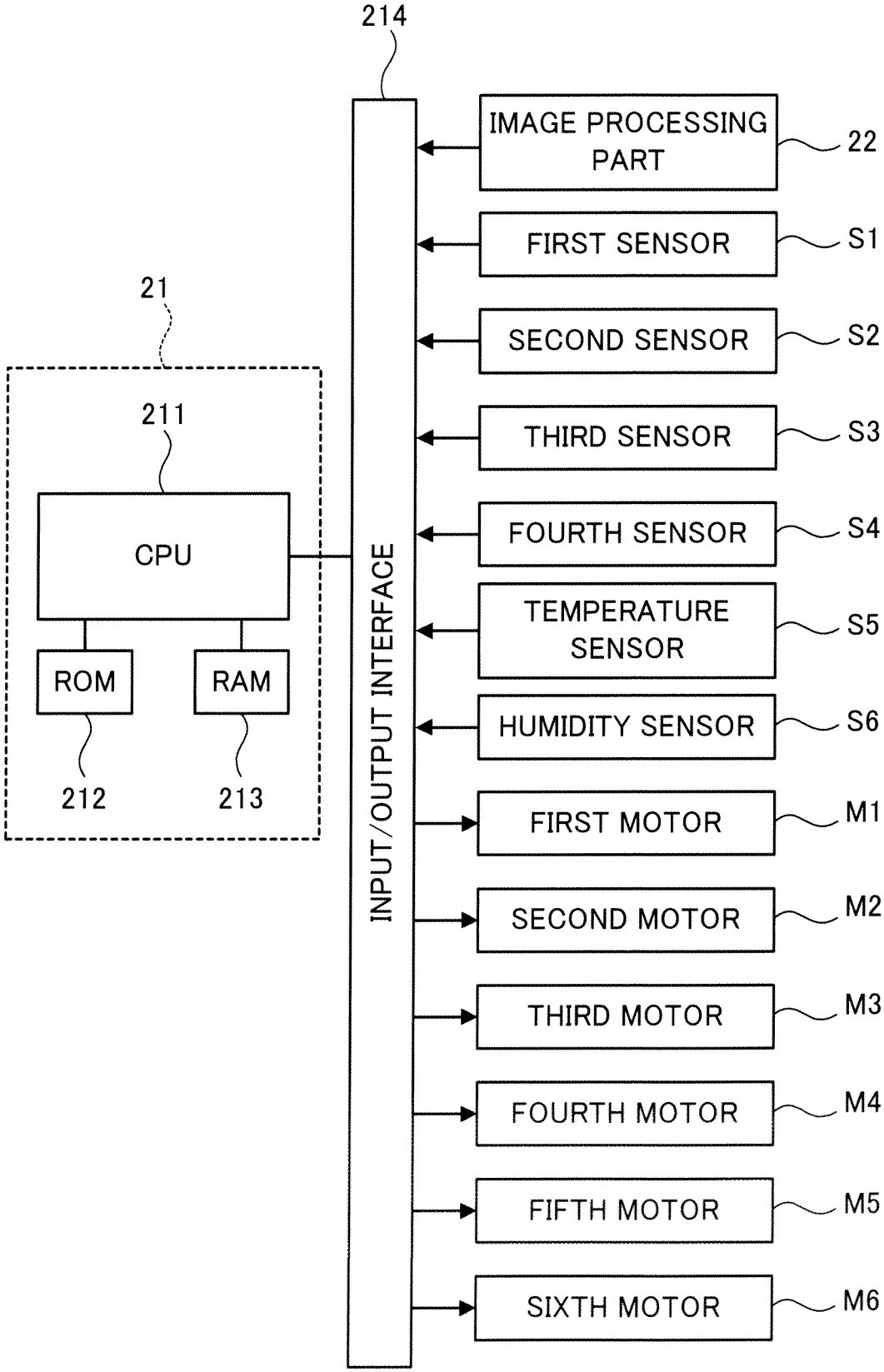
FIG. 5 is a diagram showing the control block of the controller.

Here, FIG. 5 is a diagram showing the control block of the controller 21. Note that, FIG. 5 shows only the block concerning the transportation of the waste toner.

The controller 21 includes a central processing unit (CPU) 211, a read only memory (ROM) 212, and a random access memory (RAM) 213. The CPU 211 of the controller 21 performs processing described below while exchanging data with the RAM 213, in accordance with a program stored in the ROM 212.

Here, the controller 21 receives outputs from the first to fourth sensors S1 to S4, the temperature sensor S5, and the humidity sensor S6, via an input/output interface 214. In addition, the controller 21 acquires, from the image processing part 22, image data inputted to the image processing part 22. Moreover, the controller 21 controls the first to sixth motors M1 to M6 via the input/output interface 214.

Subsequently, the process of transporting the waste toner performed by the controller 21 will be described in detail.

Figure 6:
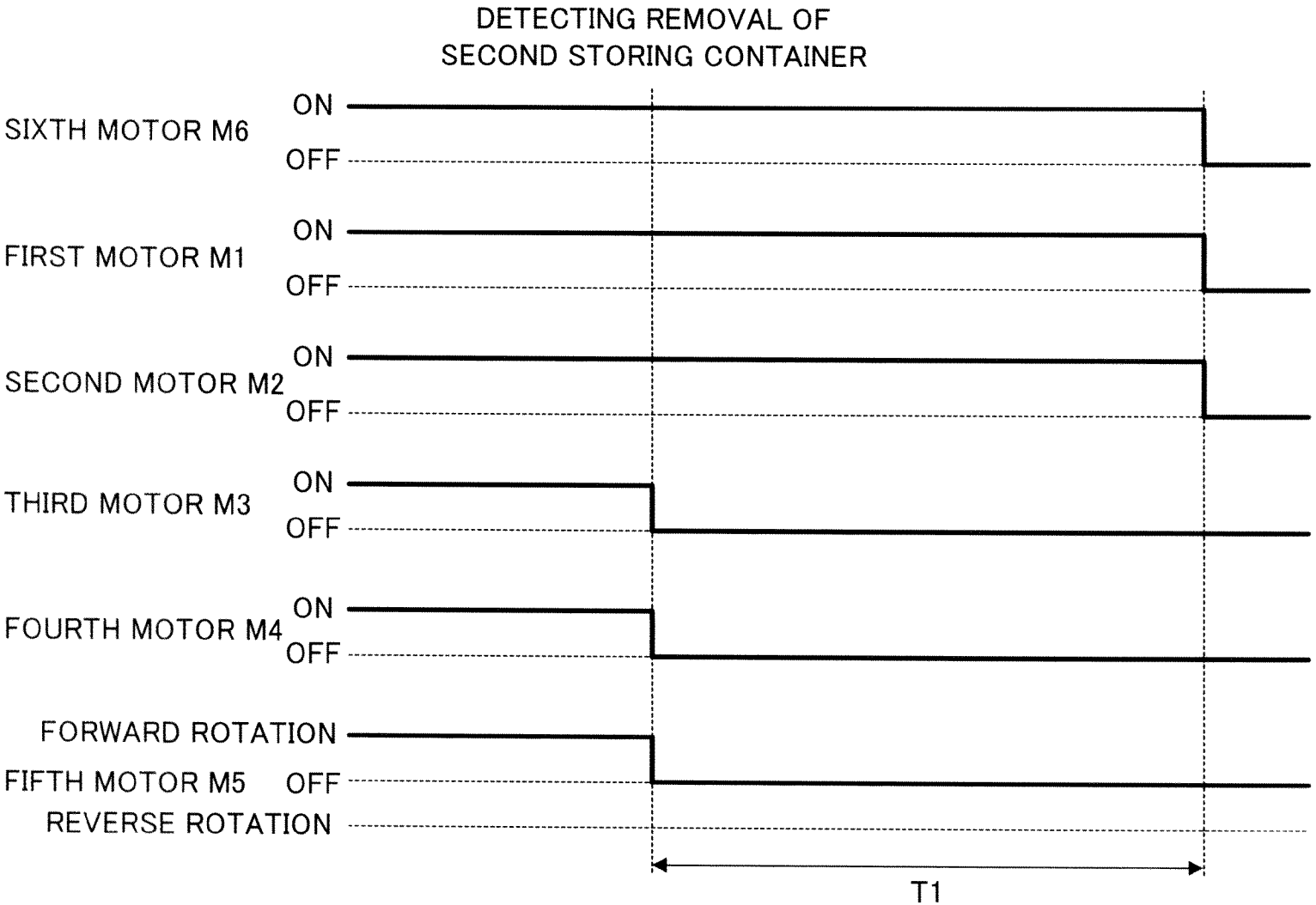
FIG. 6 is a diagram showing an operation sequence of the first to the fifth motors provided respectively to the first to the fifth transporting mechanisms as well as the sixth motor that rotationally drives the photoconductor drums.

FIG. 6 is a diagram showing an operation sequence of the first to fifth motors M1 to M5 provided respectively to the first to fifth transporting mechanisms 110 to 150 as well as the sixth motor M6 (not shown in the figure) that rotationally drives the photoconductor drums 31. Note that, as an example of this operation sequence, an operation when the second storing container 220 is further removed with the first storing container 210 having already been removed will be described. In short, the operation when both of the first and second storing containers 210 and 220 are removed will be described as an example.

As shown in FIG. 6, upon detecting that the second storing container 220 is removed on the basis of the output from the second sensor S2, the controller 21 stops the driving of the third motor M3 in the third transporting mechanism 130, the fourth motor M4 in the fourth transporting mechanism 140, and the fifth motor M5 in the fifth transporting mechanism 150. As a result, the transportation of the waste toner by the transporting member 152 is stopped, so that the waste toner is prevented from being discharged from the second discharge outlet 151B in a state where the second storing container 220 is not mounted. In addition, the transportation of the waste toner to the fifth transporting mechanism 150 having been stopped is stopped, while the reciprocation of the coil spring 132 in the third transporting mechanism 130 is also stopped.

Here, in the present exemplary embodiment, when removal of the second storing container 220 is detected, the driving of the third motor M3 and the like is stopped as described above. Incidentally, another configuration may be employed, for example, in which a cover member (not shown in the figure) or the like that is designed to be opened for the removal of the second storing container 220 is provided, and the driving of the third motor M3 and the like is stopped upon detection of the opening of the cover member.

On the other hand, the controller 21 continues the driving of the first motors M1 in the respective first transporting mechanisms 110, the second motor M2 in the second transporting mechanism 120, and the sixth motor M6 until a time T1 passes after stopping the driving of the third motor M3, the fourth motor M4, and the fifth motor M5. In this event, until the time T1 passes, the discharge of the waste toner from the cleaning units 34 (see FIG. 1) is continued, and also, the transportation of the waste toner to the tubular member 131 in the third transporting mechanism 130 is continued.

Then, the waste toner having been transported to the tubular member 131 falls down inside the tubular member 131, and is deposited inside the tubular member 131. In other words, the waste toner is accumulated inside the tubular member 131. Then, unless any one of the first and second storing containers 210 and 220 is mounted before the time T1 passes, the controller 21 stops the driving of the first and second motors M1 and M2 so as to stop the transportation of the waste toner, and also stops the driving of the sixth motor M6 so as to stop the image forming operation. Note that, in the present exemplary embodiment, if any one of the first and second storing containers 210 and 220 is not mounted before the time T1 passes, the first motor M1 and the like are stopped. Alternatively, another configuration may be employed, for example, in which a sensor or the like is provided to a side portion or the like of the tubular member 131, and the first motor M1 and the like are stopped if the sensor or the like detects that the waste toner reaches a predetermined position inside the tubular member 131.

On the other hand, if any one of the first and second storing containers 210 and 220 is mounted before the time T1 passes, the controller 21 restarts the driving of the third to fifth motors M3 to M5 (illustration thereof is omitted). In addition, during this period, the controller 21 does not stop but continues the driving of the first, second, and sixth motors M1, M2, and M6. With this configuration, the transportation of the waste toner having been accumulated inside the tubular member 131 to the storing container is started, while the transportation of the waste toner in the first and second transporting mechanisms 110 and 120 as well as the image forming operation are continued. As described above, in the present exemplary embodiment, the image forming operation is allowed to be continued without interruption if any one of the first and second storing containers 210 and 220 is mounted before the time T1 passes. Suppose the case where the cover member is provided as described above. In this case, a configuration may be employed in which, if the cover member is closed before the time T1 passes, for example, the driving of the third to fifth motors M3 to M5 is restarted while the driving of the first, second, and sixth motors M1, M2, and M6 is continued.

Consider the case where the driving of the third to fifth motors M3 to M5 is restarted in response to any one of the first and second storing containers 210 and 220 being mounted before the time T1 passes. Even in this case, since the transportation of the waste toner from the second transporting mechanism 120 is continued, the state where the waste toner is being accumulated inside the tubular member 131 may still be maintained. In other words, the state where the space available for accumulating the waste toner is being reduced inside the tubular member 131 may be maintained. For this reason, the waste toner may be discharged from the tubular member 131 by driving the third to fifth motors M3 to M5 at the timing when the image forming operation is not performed.

Note that, in the present exemplary embodiment, the reciprocation of the coil spring 132 is stopped by stopping the driving of the third motor M3 when the removal of the second storing container 220 is detected. Alternatively, the reciprocation of the coil spring 132 may be continued even in this case. However, if the reciprocation of the coil spring 132 is continued, the waste toner inside the tubular member 131 is pressed by the coil spring 132, thus being likely to be agglomerated. For this reason, at the same time when the driving of the fourth and fifth motors M4 and M5 is stopped, the reciprocation of the coil spring 132 may be stopped. Note that, although the configuration where the coil spring 132 is provided has been illustrated as the example in the present exemplary embodiment, the coil spring 132 may be omitted.

Moreover, the controller 21 may change the time T1 depending on the environment inside the image forming apparatus 1. For example, if the temperature or humidity in the image forming apparatus 1 is high, the fluidity of the waste toner decreases, so that the waste toner is less likely to fall down inside the tubular member 131. In other words, such an environment may cause a situation where the waste toner is less likely to be accumulated inside the tubular member 131. Then, if the transportation of the waste toner is continued under such condition, the clogging or the like of the waste toner may occur inside the tubular member 121, for example. For this reason, the controller 21, functioning also as a changing section, changes the time T1 to a shorter time, for example, if the temperature or humidity (examples of environmental information) inside the image forming apparatus 1 is larger than a predetermined value, for example. On the other hand, if the temperature or humidity in the image forming apparatus 1 is low, the waste toner is more likely to flow. For this reason, the controller 21 changes the time T1 to a longer time if the temperature or humidity inside the image forming apparatus 1 is lower than a predetermined value, for example. Note that, the controller 21 finds out the temperature and humidity on the basis of the outputs from the temperature sensor S5 and the humidity sensor S6.

Furthermore, the controller 21 may change the time T1 depending on the amount of the waste toner to be transported to the tubular member 131 (the amount of the waste toner to be discarded in the image forming process part 20). For example, the controller 21 changes the time T1 to a shorter time if the amount of the waste toner to be transported to the tubular member 131 is larger than a predetermined amount. On the other hand, for example, the controller 21 changes the time T1 to a longer time if the amount of the waste toner to be transported to the tubular member 131 is smaller than a predetermined amount. Note that, for example, the controller 21 may find out a density of an image on the basis of image data outputted to the image processing part 22 from the image reading apparatus 4 or the PC 5, and then find out the amount of the waste toner to be transported to the tubular member 131 on the basis of the density of the image thus found out.

Figure 7:
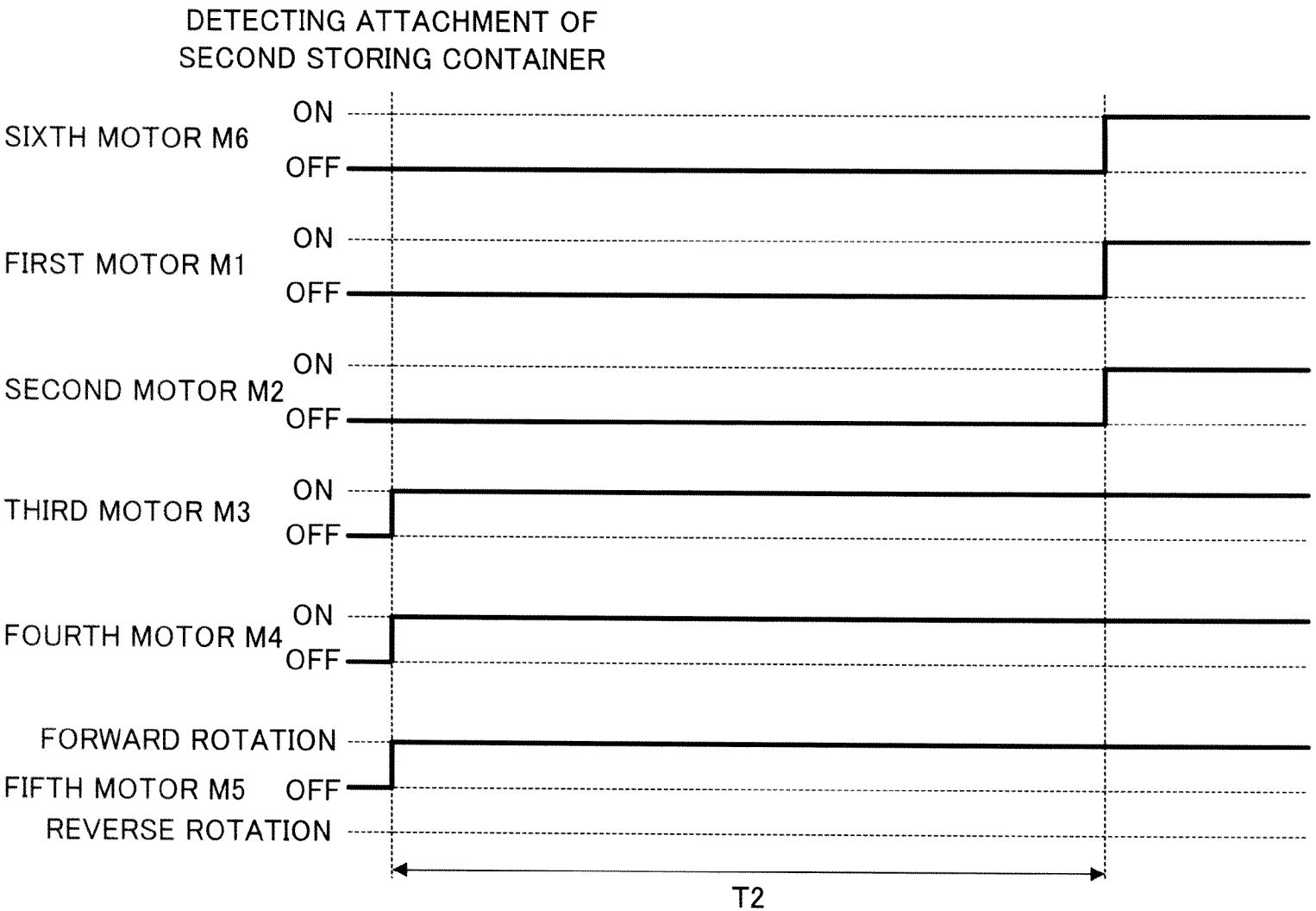

Here, FIG. 7 is a diagram showing a return sequence of the transporting mechanism 100 and the like.

As described above, if any one of the first and second storing containers 210 and 220 is not mounted within the time T1, the first motor M1 and the like are stopped, so that the transportation of the waste toner by the transporting mechanism 100 is stopped. FIG. 7 shows an operation of returning from the state where the transportation is stopped.

Upon detecting that the second storing container 220, for example, is mounted, the controller 21 first starts the driving of the third to fifth motors M3 to M5. The discharge of the waste toner to the second storing container 220 is thus restarted, and also, the waste toner having been accumulated inside the tubular member 131 starts to be discharged to the outside of the tubular member 131.

Thereafter, the controller 21 starts the driving of the first, second, and sixth motors M1, M2, and M6 after a time T2 passes from the restart of the driving of the third motor M3 and the like. The transportation of the waste toner having been located inside the first and second transporting mechanisms 110 and 120 is thus restarted, and also, the photoconductor drums 31 are rotationally driven to allow the image forming operation.

Note that, the time T2 may be set to be not less than a time required for the waste toner inside the tubular member 131 to be discharged to the outside of the tubular member 131. In other words, the driving of the first, second, and sixth motors M1, M2, and M6 may be restarted after the waste toner inside the tubular member 131 is discharged to the outside of the tubular member 131. If the driving of the first motor M1 and the like is restarted before the waste toner inside the tubular member 131 is discharged to the outside of the tubular member 131, the state where the waste toner is accumulated inside the tubular member 131 is maintained in some cases. In other words, the state where the space available for accumulating the waste toner is small inside the tubular member 131 is maintained in some cases.

Figure 8:
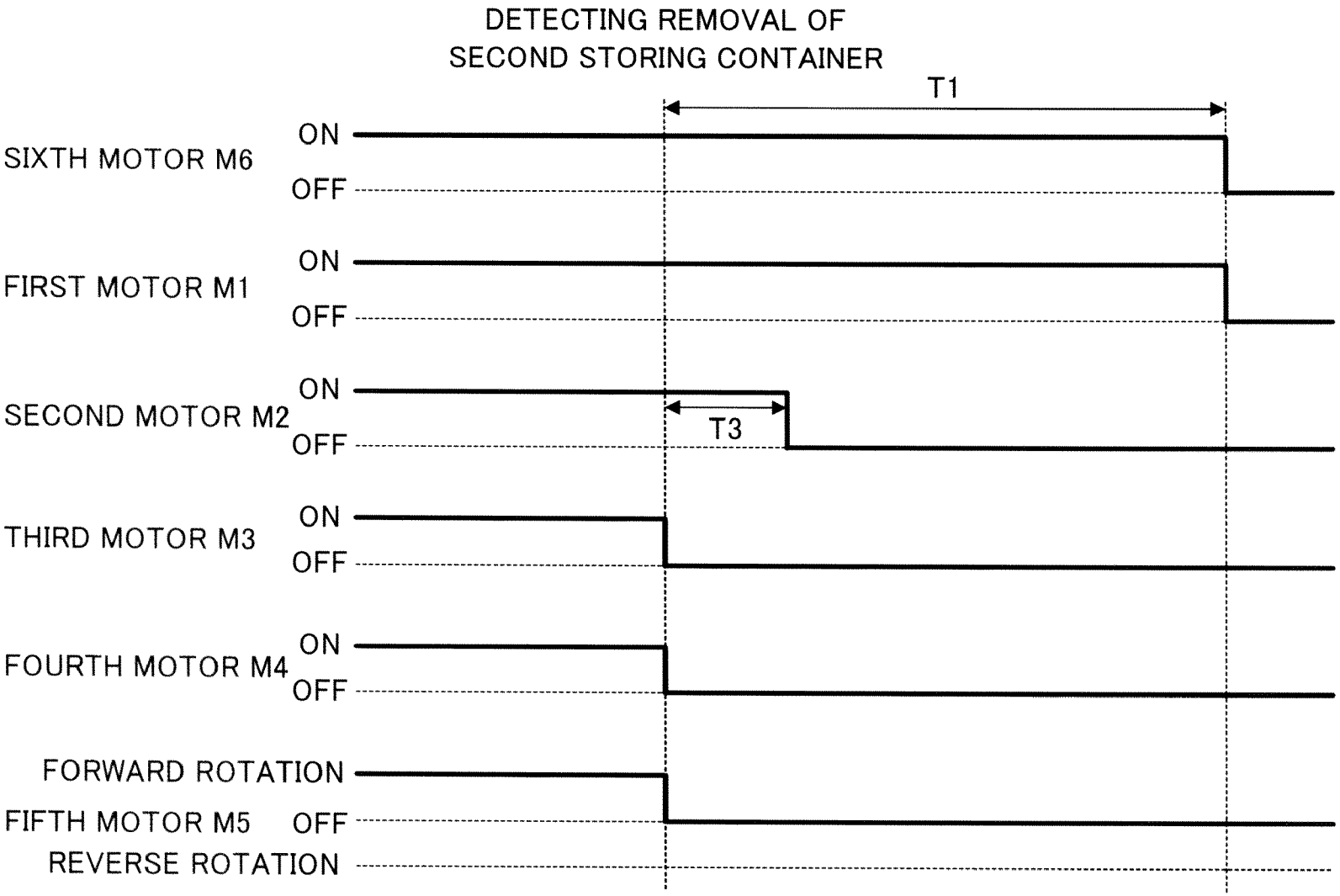
FIG. 8 is a diagram showing another example of the operation sequence of the first to the sixth motors.

Here, FIG. 8 is a diagram showing another example of the operation sequence of the first to sixth motors M1 to M6. Note that, also as an example of this operation sequence, an operation when the second storing container 220 is further removed with the first storing container 210 having already been removed will be described. In short, the operation when both of the first and second storing containers 210 and 220 are removed will be described as an example.

Upon detecting that the second storing container 220 is removed, the controller 21 stops the driving of the third to fifth motors M3 to M5 as in the case described above. Thereafter, the controller 21 stops the driving of the second motor M2 after a time T3 passes from the detection of the removal of the second storing container 220, for example. Subsequently, the controller 21 stops the driving of the first and sixth motors M1 and M6 after the time T1 passes from the detection of the removal of the second storing container 220, for example, as in the case described above.

In the transporting mechanism 100 in the present exemplary embodiment, the tubular member 111 in each of the first transporting mechanisms 110 also has space allowing the waste toner to be accumulated therein. In the processing, the waste toner is accumulated also in the space in the tubular member 111. This configuration increases the amount of the waste toner to be accumulated. As a result, the time T1, which serves as the reference for the timing to stop the first and sixth motors M1 and M6 (to stop the image forming operation), may be extended as compared with the aforementioned processing shown in FIG. 6.

To be more specific, the driving of the second motor M2 is continued until the time T3 passes after the detection of the removal of the second storing container 220. The continuous driving of the second motor M2 first causes the waste toner to be accumulated inside the tubular member 131. Then, in the processing, while the driving of the second motor M2 is stopped after the time T3 passes, the driving of the first and sixth motors M1 and M6 is continued. This configuration causes the waste toner having been transported by the transporting member 341 of each cleaning unit 34 to be accumulated inside the corresponding tubular member 111.

Note that, in the return sequence, for example, the driving of the third to fifth motors M3 to M5 is first started so as to discharge the waste toner from the tubular member 131. Thereafter, the driving of the second motor M2 is started so as to discharge the waste toner from the tubular members 111. Subsequently, the driving of the first motor M1 as well as the driving of the sixth motor M6 are started so as to restart the image forming operation. Note that, the driving of the second motor M2 may be started after the waste toner is discharged from the tubular member 131, as in the case described above.

In addition, the driving of the first and sixth motors M1 and M6 may be started after the waste toner is discharged from the tubular members 111.

Note that, in the above description, after the driving of the third to fifth motors M3 to M5 is started, the driving of the second motor M2 is started, and subsequently, the driving of the first motor M1 is started. However, both of the first and second motors M1 and M2 may be started to be driven after the driving of the third to fifth motors M3 to M5 is started.

Moreover, a motor (not shown in the figure) (hereinafter, referred to as a "seventh motor M7"), which drives the coil spring 112 in each tubular member 111 may be separately provided. In this case, in the return sequence, the driving of the third to fifth motors M3 to M5 is first started, for example. Subsequently, the driving of the second and seventh motors M2 and M7 is started. After that, the driving of the first and sixth motors M1 and M6 is started.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming section that forms an image on a recording medium;

a storage container that is detachably and attachably provided and that stores waste powder having been discarded and transported from the image forming section;

a first transporting section that transports, from the image forming section, the waste powder having been discarded in the image forming section;

a transport path through which the waste powder having been transported by the first transporting section is caused to fall down and is transported;

a second transporting section that transports, to the storage container, the waste powder having been transported through the transport path; and a controller that stops driving of the second transporting section if an operation set in advance is executed when the storage container is removed, wherein the first transporting section comprises:

an upstream-side transporting mechanism that transports, from the image forming section, the waste powder having been discarded in the image forming section;

a falling-down transport path through which the waste powder having been transported by the upstream-side transporting mechanism is caused to fall down and is transported; and a downstream-side transporting mechanism that transports, to the transport path, the waste powder having been transported through the falling-down transport path, and the controller further stops driving of the downstream-side transporting mechanism of the first transporting section if a condition set in advance is satisfied, after stopping the driving of the second transporting section, wherein the controller further stops the driving of the downstream-side transporting mechanism of the first transporting section in at least any one of cases where the storage container that has been removed is not attached within a time period set in advance and where the waste powder reaches a specified position of the transport path.

2. The image forming apparatus according to claim 1, wherein the controller stops the driving of the second transporting section in at least any one of cases where the storage container is removed and where a cover member is opened, the cover member being opened when the storage container is removed.

3. The image forming apparatus according to claim 1, wherein the controller further stops driving of the upstream-side transporting mechanism of the first transporting section if a condition set in advance is satisfied, after stopping the driving of the downstream-side transporting mechanism of the first transporting section, and the controller restarts the driving of the upstream-side transporting mechanism after restarting the driving of the downstream-side transporting mechanism, if restarting the driving of the upstream-side transporting mechanism and the downstream-side transporting mechanism that have been stopped.

4. The image forming apparatus according to claim 3, wherein the controller further stops the driving of the upstream-side transporting mechanism of the first transporting section in at least any one of cases where the storage container that has been removed is not attached within a time period and where the waste powder reaches a specified position of the falling-down transport path.

5. An image forming apparatus comprising:

an image forming section that forms an image on a recording medium;

a storage container that is detachably and attachably provided and that stores waste powder having been discarded and transported from the image forming section;

a first transporting section that transports, from the image forming section, the waste powder having been discarded in the image forming section;

a second transporting section that transports the waste powder to the storage container;

a transport path through which the waste powder transported from the first transporting section is transported to the second transporting section; and a controller that stops driving of the second transporting section if an operation set in advance is executed when the storage container is removed, the transport path being provided in such a manner that the waste powder to be transported by the first transporting section after the driving of the second transporting section is stopped by the controller is accumulated in the transport path, wherein the controller further stops driving of the first transporting section if a condition set in advance is satisfied, after stopping the driving of the second transporting section, and the controller restarts the driving of the first transporting section after restarting the driving of the second transporting section, if restarting the driving of the first transporting section and the second transporting section that have been stopped, wherein the controller further stops the driving of the first transporting section in at least any one of cases where the storage container that has been removed is not attached within a time period and where a certain amount of the waste powder is accumulated in the transport path.

6. The image forming apparatus according to claim 5, wherein the controller stops the driving of the second transporting section in at least one of cases where the storage container is removed and where a cover member is opened, the cover member being opened when the storage container is removed.

7. The image forming apparatus according to claim 5, wherein the controller further stops driving of the first transporting section if an operation set in advance regarding attachment of the storage container is not executed within a time period set in advance, after the driving of the second transporting section is stopped, and the controller restarts the driving of the second transporting section, and also continues the driving of the first transporting section without stopping the driving of the first transporting section if the operation set in advance is executed within the time period set in advance.

8. The image forming apparatus according to claim 7, wherein the controller stops the driving of the first transporting section in at least any one of cases where the storage container that has been removed is not attached, and where the cover member is not closed, within a time period set in advance, the cover member being opened when the storage container is removed, and the controller continues the driving of the first transporting section without stopping the driving of the first transporting section, and restarts the driving of the second transporting section in at least any one of cases where the storage container that has been removed is attached, and where a cover member is closed, within a time period set in advance, the cover member being opened when the storage container is removed.

9. The image forming apparatus according to claim 5, further comprising a changing section, wherein the controller further stops a driving of the first transporting section if an operation set in advance regarding an attachment of the storage container is not executed within a time period set in advance, after the driving of the second transporting section is stopped, and the changing section acquires information on an amount of the waste powder to be discarded from the image forming section, and changes the time period set in advance on the basis of the information thus acquired.

10. The image forming apparatus according to claim 9, wherein the controller further stops the driving of the first transporting section, in at least any one of cases where the storage container that has been removed is not attached, and where a cover member is not closed, within a time period set in advance, the cover member being opened when the storage container is removed.

11. The image forming apparatus according to claim 5, further comprising a changing section, wherein the controller further stops a driving of the first transporting section if an operation set in advance regarding an attachment of the storage container is not executed within a time period set in advance after the driving of the second transporting section is stopped, and the changing section acquires environmental information on an environment inside the image forming apparatus, and changes the time period set in advance on the basis of the environmental information thus acquired.

12. The image forming apparatus according to claim 11, wherein the controller further stops the driving of the first transporting section in at least any one of cases where the storage container that has been removed is not attached and where a cover member is not closed, within a time period set in advance, the cover member being opened when the storage container is removed.

13. The image forming apparatus according to claim 5, further comprising a breaking member that is provided in the transport path and that breaks down waste powder attached to an inner wall surface of the transport path, wherein when stopping the driving of the second transporting section, the controller stops also the breaking member.

14. A waste powder transporting method of an image forming apparatus including: an image forming section that forms an image on a recording medium and a storage container that is detachably and attachably provided and that stores waste powder having been discarded and transported from the image forming section, the waste powder transporting method comprising:

transporting, by a first transporting section, the waste powder having been discarded in the image forming section;

causing the waste powder having been transported to fall down and transporting the waste powder through a transport path;

transporting, by a second transporting section, the waste powder having been transported through the transport path, to the storage container; and stopping, the second transporting section, if an operation set in advance is executed when the storage container is removed, wherein the first transporting section comprises:

an upstream-side transporting mechanism that transports, from the image forming section, the waste powder having been discarded in the image forming section;

a falling-down transport path through which the waste powder having been transported by the upstream-side transporting mechanism is caused to fall down and is transported; and a downstream-side transporting mechanism that transports, to the transport path, the waste powder having been transported through the falling-down transport path, and the controller further stops driving of the downstream-side transporting mechanism of the first transporting section if a condition set in advance is satisfied, after stopping the driving of the second transporting section, wherein the controller further stops the driving of the downstream-side transporting mechanism of the first transporting section in at least any one of cases where the storage container that has been removed is not attached within a time period set in advance and where the waste powder reaches a specified position of the transport path.

15. The waste powder transporting method according to claim 14, wherein the driving of the second transporting section is stopped in at least any one of cases where the storage container is removed and where a cover member is opened, the cover member being opened when the storage container is removed.

* * * * *